US005570828A

United States Patent [19]

Lewis

[11] Patent Number: 5,570,828

[45] Date of Patent: Nov. 5, 1996

[54] DISPOSABLE PROMOTIONAL BACK PACK AND METHOD OF FABRICATING SAME

[76] Inventor: Ann Lewis, 712 Cristy Ct., Woodstock, Ga. 30188

[21] Appl. No.: 504,248

[22] Filed: Jul. 19, 1995

[51] Int. Cl.[6] ..... A45F 3/04

[52] U.S. Cl. ..... 224/627; 224/906; 383/24; 383/66

[58] Field of Search ..... 224/209, 906, 224/153, 154, 155, 156, 151; 383/24, 66; 150/107, 127, 128

[56] References Cited

U.S. PATENT DOCUMENTS

| | | | |
|---|---|---|---|
| 1,501,134 | 7/1924 | Osburn . | |
| 3,269,637 | 8/1966 | Whittaker . | |
| 3,471,163 | 10/1969 | Swara . | |
| 3,998,304 | 12/1976 | Edgerton, Jr. et al. | 383/24 |
| 4,054,166 | 10/1977 | Burke . | |
| 4,318,505 | 3/1982 | Cordell, Jr. . | |
| 4,423,834 | 1/1984 | Rush | 224/153 |
| 4,609,084 | 9/1986 | Thomas . | |
| 4,778,090 | 10/1988 | Facchina | 224/153 |
| 5,090,526 | 2/1992 | Jacober | 224/209 |
| 5,255,834 | 10/1993 | Bendersky | 224/209 |
| 5,346,308 | 9/1994 | Buhot et al. | 224/153 |
| 5,377,887 | 1/1995 | Garcia | 224/153 |

*Primary Examiner*—David J. Walczak
*Attorney, Agent, or Firm*—Hopkins & Thomas

[57] ABSTRACT

A disposable plastic back pack is formed from a substantially rectangular sheet of plastic material folded over onto itself and heat sealed at its top and bottom to form a pouch. Plastic strips are attached at their ends to the top and bottom of the pouch to provide shoulder straps and a pocket for personal items is provided on the side of the pouch that is worn against a user's back. The side of the back pack facing away from a wearer is printable with promotional indicia that can easily be seen since it is worn at or just below eye level.

15 Claims, 2 Drawing Sheets

FIG. 3B
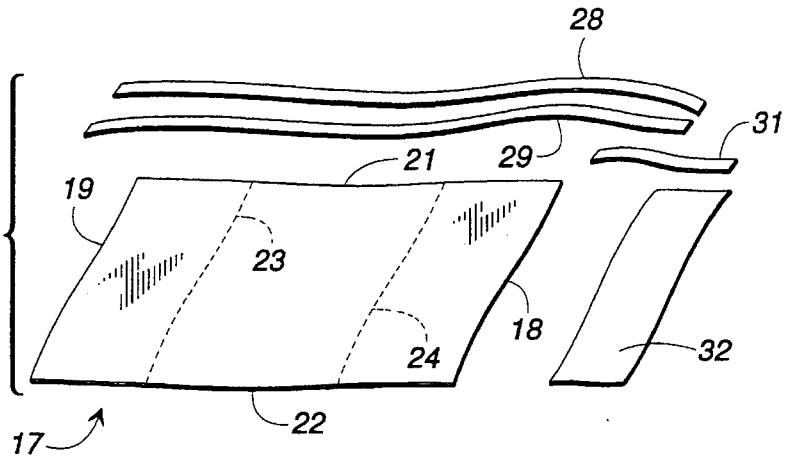
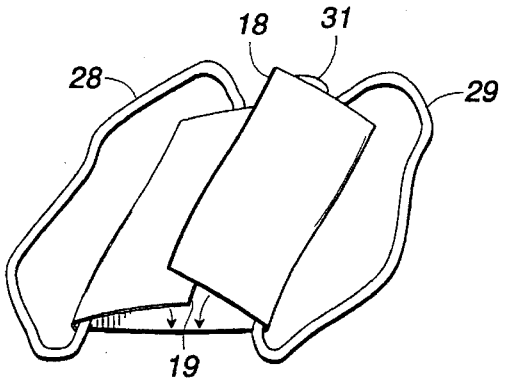
FIG. 3B
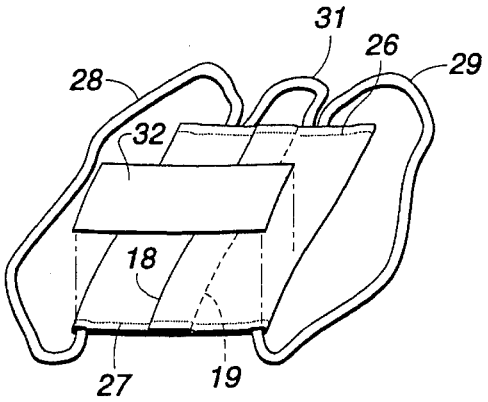
FIG. 3C
FIG. 3D
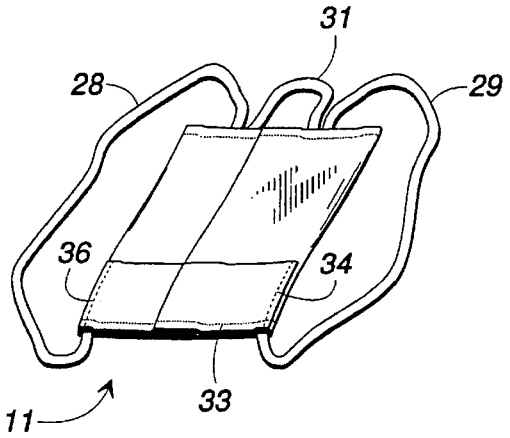

DISPOSABLE PROMOTIONAL BACK PACK AND METHOD OF FABRICATING SAME

TECHNICAL FIELD

This invention relates generally to containers for carrying items and more particularly to a disposable plastic container having shoulder straps to allow the container to be worn as a back pack.

BACKGROUND OF THE INVENTION

Attendees at tradeshows, trade conventions, and similar events tend to collect a substantial amount of literature, samples, and other items provided by vendors displaying their goods and services at the event. To accommodate these items, some vendors, and usually the tradeshow sponsor itself, will provide simple plastic bags into which collected items can be placed for convenient carrying. Sometimes these bags are printed with the trademark or service mark of a vendor providing the bag so that the bag doubles as a medium for promotional advertisement.

While simple plastic bags are distributed by the thousands at tradeshows and serve their purpose of providing a convenient carrier for articles collected at the show, these simple bags embody certain inherent problems and shortcomings. For example, while the bags typically are used by patrons at the show itself, they usually are simply discarded immediately after show when the materials carried therein are taken out and filed. In addition, any vendor advertisements that may be printed on the bags have a diminished impact because the bags, when carried, are positioned at about knee level such that advertisements printed thereon are not readily visible. This is particularly true in large crowds common at tradeshows and conventions where the mere closeness of the individuals obscures any promotional ads printed on carried bags.

Another problem with carried plastic bags at events such as tradeshows is that they necessarily engage one hand of a user. This is particularly inconvenient since the attendees at tradeshows usually need to exchange business cards, fill out information forms, test certain displayed products at the show, and otherwise engage in activities that require use of their hands. When engaging in this activity, the plastic bag usually is either slid up the user's arm to the elbow or placed on the floor. Clearly, either alternative is inconvenient and placing the bag on the floor results in a substantial instance of lost materials.

Finally, attendees at tradeshows and conventions often carry personal items with them such as cameras, sunglasses, and the like. It is inconvenient to place these personal items in a plastic carrying bag along with all of the materials collected at the show because, when the items are needed, one must rummage through the bag to find them. In addition, sunglasses, camera lenses, and other delicate surfaces can become scratched or otherwise deteriorated by rubbing against the promotional material and samples within the bag.

Thus, there exists a continuing and heretofore unaddressed need for an improved container for carrying items collected at tradeshows and conventions. During normal use, the container should securely contain all the brochures and samples collected at a convention. In addition, it should provide means for storing personal items such as sunglasses and cameras in a safe easily accessible way. The container should leave a user's hands free and, during normal use, should display printed promotional advertisements at or near eye level rather than knee level so that the ads can be more effective. The container should be reusable for other purposes after the show so that the printed advertisements thereon can have continued effect. Finally, the container should be made of biodegradable material so that, when disposed, it does not adversely impact the environment. It is to the provision of such a container that the present invention is primarily directed.

SUMMARY OF THE INVENTION

Briefly described, the present invention, in a preferred embodiment thereof, comprises a disposable back pack for use by attendees at conventions and tradeshows to contain promotional materials and samples collected at the show. The back pack of this invention comprises a substantially rectangular sheet of plastics material having a top edge, a bottom edge, and ends. The sheet of plastics material is folded over onto itself along a first fold line spaced from one of its ends and along a second fold line spaced from the other one of its ends. The fold lines are located so that the ends of the folded sheet substantially meet and, preferably, overlap along a line intermediate the fold lines.

The folded sheet of plastics material is then sealed along its top and bottom edges to form a substantially rectangular pouch with the sealed top and bottom edges forming the top and bottom of the pouch respectively and the fold lines forming the sides of the pouch. The overlapping ends of the plastics sheet define a slot on one side of the pouch extending between the top and bottom of and providing access to the pouch.

First and second elongated strips of plastics material are each secured at one end to the top of the pouch and at the other end to the bottom of the pouch to form a pair of shoulder straps through which a wearer's arms can be inserted to support the pouch on the wearer's back. When donned by a wearer in this way, the slot providing access into the pouch is positioned against the wearer's back and the other side of the pouch faces away from the wearer. This other side of the pouch is printable with advertising or promotional indicia that may be placed by event sponsors, food or beverage retailers, or anyone wishing to advertise their goods or services. When the pouch is worn by a user, the printed promotional material is displayed on the back of the wearer at or just below the eye level of others. Accordingly, the promotional indicia is much more effective than it would be on a bag carried to one's side since it is easily visible and not obscured by crowds of people.

The back pack of this invention also preferably includes a second rectangular sheet of plastics material having a bottom edge and ends. The bottom edge of the second sheet is sealed along the bottom of the pouch and the ends of the second sheet are sealed along the sides of the pouch with the plastic sheet positioned against the side of the pouch that rests against the wearer's back. Thus, the second sheet of plastics material forms a pocket that both spans the bottom portion of the access slot, thus helping to hold the materials in the pouch, and provides an independent pocket for storing sunglasses, cameras, and other personal items.

Finally, the disposable back pack of the present invention is formed of inexpensive plastics material that preferably is biodegradable so that, when discarded, the entire back pack dissolves and does not adversely affect the environment.

Accordingly, it is an object of this invention to provide an improved container for carrying promotional materials, samples and other items at tradeshows and conventions.

Another object of the invention is to provide a disposable back pack that can be used to contain promotional materials, samples, and other items at tradeshows and conventions and that is worn on the back to free the hands of the wearer.

A still further object of the invention is to provide a carrying container that can be printed with promotional indicia that is displayed at about eye level so that the advertising impact of the indicia is increased.

A further object of the invention is to provide a disposable plastic back pack that has a separate pocket for carrying personal items.

An additional object of the invention is to provide a container for carrying materials at tradeshows and conventions that is biodegradable so that it does not adversely impact landfills or the environment.

These and other features, objects, and advantages of the invention will become more apparent upon review of the detailed description set forth below taken inconjunction with the accompanying drawings, which are briefly described as follows.

BRIEF DESCRIPTION OF THE DRAWINGS

FIGS. 3*a*–3*d* illustrated one preferred method of fabricating the disposable back pack of the present invention.

DETAILED DESCRIPTION OF THE PREFERRED EMBODIMENTS

Figure 1:
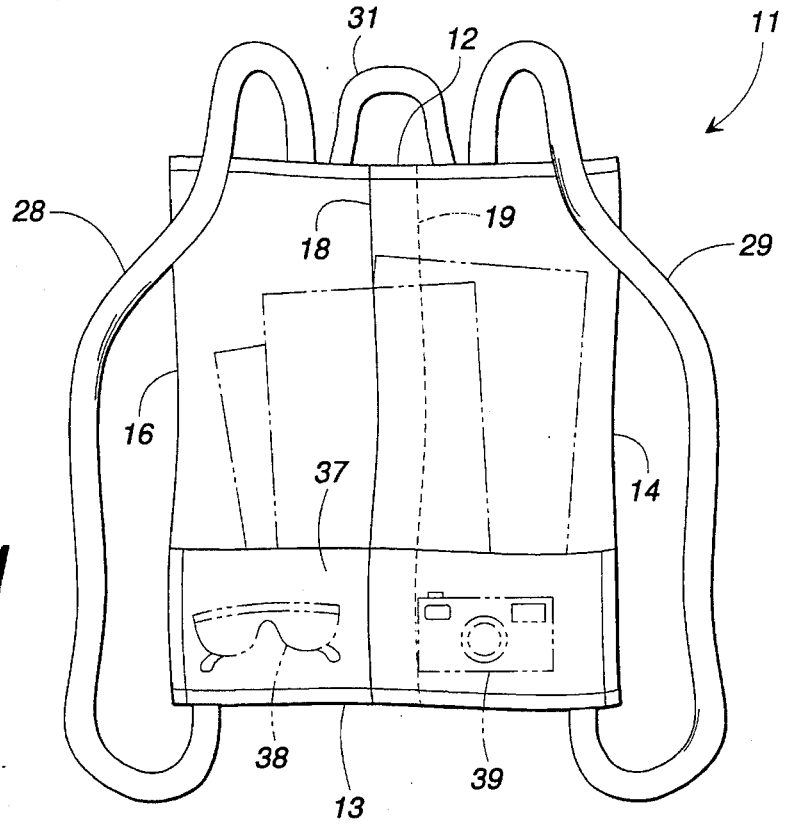
FIG. 1 is an elevational view of the back pack of this invention showing the side of the back pack that rests against a wearer's back when the back pack is in use.
Figure 2:
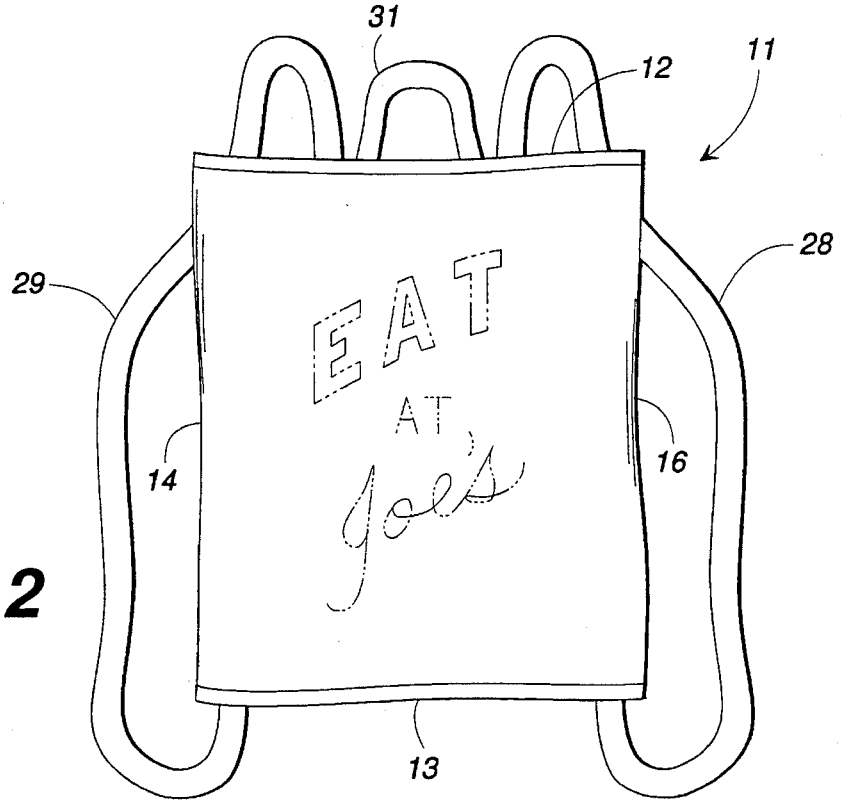
FIG. 2 is an elevational view of the invention seen from the back and showing a sample of promotional advertising that may be printed on the pack.

Referring now in more detail to the drawings, in which like numerals refer to like parts throughout the several views, FIGS. 1 and 2 illustrate a disposable plastic back pack that embodies principles of the present invention in a preferred form. The back pack 11 is generally rectangular in nature and has a top 12, a bottom 13, and sides 14 and 16. As demonstrated through the sequence of FIGS. 3*a*–3*d*, the back pack 11 is formed from a generally rectangular sheet 17 of thin plastic film of the type commonly associated with disposable bags. The sheet 17 has ends 18 and 19, a top edge 21, and a bottom edge 22. Fold lines 23 and 24 are defined on the sheet 17 and each fold line is spaced from and oriented parallel to one of the ends of the sheet.

In forming the disposable back pack of the present invention, the sheet 17 is folded over onto itself along the fold lines 23 and 24 as illustrated in FIG. 3*b*. The fold lines 23 and 24 are positioned such that when the sheet 17 is folded along these lines, the ends 18 and 19 of the sheet meet and, preferably, overlap at a location between the fold lines. When folded in this way, the top and bottom edges of the folded flaps align with the top and bottom edge of the remaining portion of the sheet 17. With these edges aligned, they are heat sealed to one another along the top and bottom as indicated by numerals 26 and 27, respectively. The folded sealed sheet, then, forms a generally rectangular pouch and the overlapping ends 18 and 19 define a flap providing access to the interior of the pouch.

The components that make up the disposable back pack of the present invention include a first strip 28 and a second strip 29 of elongated plastics material. A third shorter strip 31 of plastics material is also provided along with a smaller rectangular sheet of plastics material 32. As seen in FIG. 3*b*, when the sheet 17 is folded onto itself along fold lines 23 and 24, the ends of the strips 28 and 29 are positioned as shown within the folded sheet at locations on the top and bottom edges thereof. Thus, when the top and bottom edges are heat sealed together as indicated in FIG. 3*c*, the strips 28 and 29 become sealed as well and thus become firmly attached to the pouch formed by the folded sealed sheets. These strips, then, form the shoulder straps of the disposable back pack of the present invention. The shorter strip 31 of plastics material is positioned with its ends located at spaced positions along the top of the pouch preferably straddling the middle thereof. Upon sealing of the top edge, the strip 31 forms a handle with which the back pack 11 can be lifted, carried, or hoisted onto the back of wearer.

As illustrated in FIG. 3*c*, the smaller rectangular sheet 32 of plastics material is positioned at the bottom of the folded sealed pouch and is heat sealed to the pouch along its bottom edge and ends as referenced by the numerals 33, 34, and 36 in FIG. 3*d*. When attached to the pouch in this way, the sheet 32 forms an upwardly open pocket 37 (FIG. 1) at the bottom of the back pack 11. The pocket 37 spans and covers the lower portion of the access slot formed by overlapping ends 18 and 19. This helps to stabilize the access slot and helps hold material within the back pack securely in place. In addition, the pocket 37 provides a convenient storage location for personal items such as sunglasses 38, cameras 39, or other similar items. When stored in the pocket, these items can be easily accessed by a wearer and they do not become mixed with the materials and samples stored inside the back pack.

The disposable plastic back pack 11 can be produced extremely economically from materials that are disposable such as thin plastic sheets. These back packs can then be given away at conventions and tradeshows for use by the attendees at the shows. When at the shows, the attendees need only place collected materials in the pouch through the slot provided by overlapping ends 18 and 19. Personal items can be placed in the pocket 37. The back pack can then be donned by placing one's arms through the straps 28 and 29 and wearing the back pack 11 on the back with the access slot positioned against the back. In this way, the materials within the back pack are protected and do not tend to fall out of the pouch.

As indicated in FIG. 2, the other side of the back, which is visible when the back is worn, provides a surface on which promotional indicia can be printed. Such indicia might include the name of a sponsor, the name of a food or soft drink company, or any other advertising that can be printed on a surface. As the back pack 11 of the present invention is worn at conventions and tradeshows, the advertisements printed thereon are easily visible at or just below eye level for all of the many attendees. In addition, when attendees leave the convention or show wearing the pack, the advertisement moves onto the streets and can be seen by common pedestrians. Finally, the usefulness of the back pack is not limited to containing items at a show. Accordingly, it is likely that patrons of the shows will keep the back packs and use them as a common back pack after the show is over rather than discarding them as they would a mere carrying bag. This enhances the effectiveness of any advertising on the back pack since it is seen over and over again each time the pack is used.

It has been mentioned that the back pack of the present invention is disposable. This is because it is formed inexpensively of a material that is itself inexpensive and ultimately discardable. Since the entire item is discardable, it is preferable that the plastics material chosen for its construction be biodegradable over time so that the discarded back packs do not clog land fills or otherwise adversely affect the environment. Instead, they simply deteriorate over time reincorporating into the earth from which they came.

The invention has been described herein terms of preferred embodiments and methodology. It will be obvious to those of skill in the art, however, that various changes might be made to the illustrated embodiments within the scope of the invention. For example, the back pack could be formed of canvas or another more permanent material. Under these circumstances, the back pack would not be discardable but would be an item that could be used over and over for years. In addition, the preferred order in which the steps of the fabrication process are performed have been discussed. Obviously, however, these steps might be performed in a different order or in slightly different ways without detracting from the invention itself. These and other additions, deletions, and modifications might well be made to the illustrated embodiments without departing from the spirit and scope of the invention as set forth in the claims.

I claim:

1. A disposable back pack adapted to be worn on the back of a wearer, said back pack comprising a substantially rectangular sheet of plastics material having a top edge, a bottom edge, and ends, said sheet being folded over onto itself along a first fold line spaced from one of said ends and along a second fold line spaced from the other one of said ends so that said ends are adjacent to each other along a line intermediate said fold lines, said folded sheet being sealed to itself along its top and bottom edges to form a substantially flat rectangular pouch with the sealed together top and bottom edges forming the top and bottom of said pouch, the fold lines forming the sides of said pouch, and the adjacent ends of the plastics sheet forming an open slot on one surface of said pouch extending between the top and bottom of and providing access to said pouch, first and second elongated strips of plastics material having ends with each strip being secured at one end to the sealed together top of said pouch and secured at its other end to the sealed together bottom of said pouch to form a pair of shoulder straps for receiving the arms of the wearer to support said pouch on the wearer's back with said open slot positioned against the back.

2. A disposable plastic back pack as claimed in claim 1 and wherein said fold lines are positioned and spaced so that said ends overlap each other by a predetermined amount to form a flap through which access to said pouch is provided.

3. A disposable plastic back pack as claimed in claim 1 and further comprising a third elongated strip of plastics material having ends fixed to said pouch at spaced locations along said top of said pouch to provide a handle with which said pouch can be carried.

4. A disposable plastic back pack as claimed in claim 1 and wherein said elongated strips of plastics material are secured to the top and bottom of said pouch adjacent intersections of the sides of said pouch with the top and bottom of said pouch.

5. A disposable plastic back pack as claimed in claim 1 and and further comprising a second substantially rectangular sheet of plastics material having top and bottom edges and ends and being sealed along its bottom edge to the bottom of said pouch and along its ends to the sides of said pouch to form a pocket for holding items.

6. A disposable plastic back pack as claimed in claim 5 and wherein said said pocket is positioned to span and cover at least a portion of said adjacent ends of said sheet of plastics material.

7. A disposable plastic back pack as claimed in claim 6 and wherein said pocket extends from the bottom of said pouch to a position intermediate the top and bottom of said pouch.

8. A disposable plastic back pack as claimed in claim 1 and wherein the surface of said pouch opposite said slotted surface is adapted to be printed with advertising indicia that is displayed when said pouch is worn by a wearer.

9. A disposable plastic back pack as claimed in claim 1 and wherein said plastics material is biodegradable.

10. A disposable plastic back pack as claimed in claim 1 and wherein said plastics sheet is heat sealed along its top and bottom edges.

11. A method of fabricating of disposable plastic back pack adapted to be worn on the back of a wearer, said method comprising the steps of:

(a) providing a substantially rectangular sheet of plastics material having top and bottom edges and ends;

(b) folding the sheet of plastics material onto itself along a first fold line spaced from one end of the sheet and along a second fold line spaced from the other end of the sheet, the fold lines being located so that the ends of the sheet substantially meet along a line intermediate the fold lines;

(c) sealing the folded plastics sheet to itself along its top and bottom edges to form a substantially flat rectangular pouch with the sealed together top and bottom edges of the sheet forming the top and bottom of the pouch, with the fold lines forming the sides of the pouch, and with the ends of the sheet forming a slot for access to the pouch;

(d) sealing one end of a first elongated plastic strip to the top of the pouch and sealing the other end of the first elongated plastic strip to the bottom of the pouch to form a first shoulder strap; and (e) sealing one end of a second elongated plastic strip to the top of the pouch and sealing the other end of the second elongated plastic strip to the bottom of the pouch to form a second shoulder strap, whereby the pouch can be worn as a back pack on the back of the wearer with its slot positioned against the wearer's back.

12. The method of claim 11 and further comprising the step of sealing the ends of a third elongated plastic strip at spaced locations along the top of the pouch to form a handle by which the pouch can be grasped and carried.

13. The method of claim 11 and further comprising the step of providing a second substantially rectangular sheet of plastics material having a top edge, a bottom edge, and ends, sealing the bottom edge of the second sheet along the bottom of the pouch, and sealing the ends of the second sheet to the pouch to form an upwardly open pocket for receiving and holding items.

14. The method of claim 13 and wherein the second sheet of plastics material is positioned to span and at least partially cover the slit.

15. The method of claim 11 and wherein in step (b) the sheet is folded so that its ends overlap a predetermined amount to form a flap for access to the pouch.

* * * * *